US005335684A

United States Patent [19]

Hanninen

[11] Patent Number: 5,335,684

[45] Date of Patent: Aug. 9, 1994

[54] COVERED FRAME SHELTER AND METHOD OF ERECTION

[76] Inventor: Arvi K. Hanninen, Box 33011, Regina, Saskatchewan, Canada, S4T 7X2

[21] Appl. No.: 974,069

[22] Filed: Nov. 10, 1992

[51] Int. Cl.[5] ..... E04H 15/36

[52] U.S. Cl. ..... 135/102; 135/112; 135/115; 135/103; 135/119

[58] Field of Search ..... 135/102, 105, 106, 906, 135/109, 110, 112, 113, 114, 115, 119, 103; 52/641

[56] References Cited

U.S. PATENT DOCUMENTS

| | | | |
|---|---|---|---|
| 2,575,572 | 11/1951 | Wickstrum | 135/102 X |
| 3,080,875 | 3/1963 | Bartlett | 135/102 |
| 3,424,179 | 1/1969 | Minot | 135/906 X |
| 3,798,851 | 3/1974 | Utahara | 135/102 X |
| 4,055,030 | 10/1977 | Earnshaw | 135/105 X |
| 4,593,710 | 6/1986 | Stafford et al. | 135/102 |
| 4,644,706 | 2/1987 | Stafford et al. | 135/102 X |
| 4,667,692 | 5/1987 | Tury et al. . | |
| 4,885,877 | 12/1989 | Hunt et al. | 135/102 X |

FOREIGN PATENT DOCUMENTS 1246960 12/1988 Canada .

*Primary Examiner*—Carl D. Friedman
*Assistant Examiner*—Lan C. Mai

[57] ABSTRACT

A generally rectangular shelter with a readily assembled frame mounted on a base and covered with a flexible sheet material secured to the frame and base is provided. The base is normally of wood and is placed on the ground or other planar surface Spaced at a desirable distance along each side of the base are pivotal and adjustable supports fixed to the base. To the supports are connected a series of assembled frame ribs transverse to the length of shelter. The frame ribs are normally assembled in an arcuate shape from several pieces of tubing coupled together by a special coupler. The tubes are adapted to receive other tubes by having pin receiving tabs welded to them in appropriate places. Purlins or other spacers are connected between the frame ribs so that all the frame ribs may be drawn up from an assembled horizontal position to an upright position as a unit. Cross bracing is placed between the frame ribs as required and a cover formed of several panels of flexible sheet material is then placed over the erected frame to form a basic shelter. The several panels are generally insulated fabric and are secured to the frame ribs by having all edges carrying a single continuous draw cord. The panels overlap with the overlapping side edges carrying the draw cord partially wrapping each panel side edge around an adjacent frame rib covered by each panel in a sealing and securing relationship when the panels are tightened by the pivotal and adjustable supports. The ends of the panels include grommets that receive fasteners that are imbedded in the base for total securement of the panels. Front and rear basically semi-circular panels are each secured to an end rib and the base in a similar manner and are placed against front and rear end wall posts of front and rear end walls which are assembled before or after pivoting and are connected to the base and an end frame rib. The total cover or the basic shelter cover is tightened by vertically adjusting all the pivotal and adjustable supports fastened to the base each carrying a bottom end of a frame rib.

18 Claims, 5 Drawing Sheets

Fig. 4
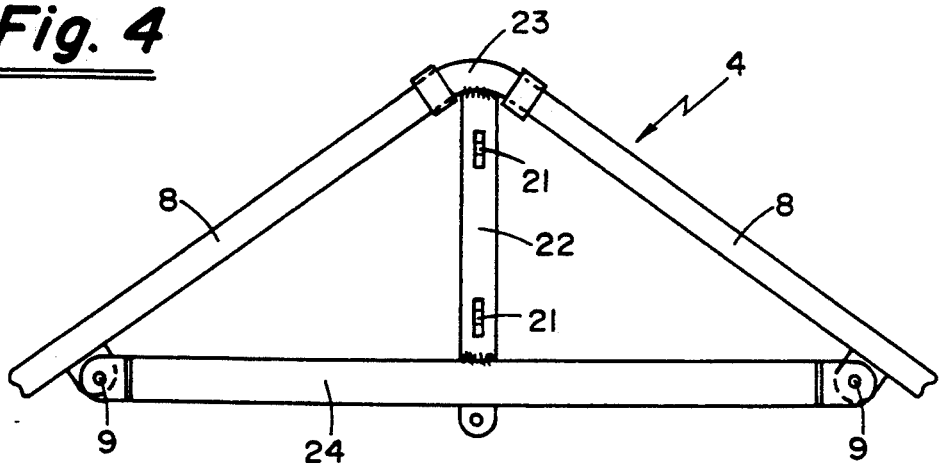
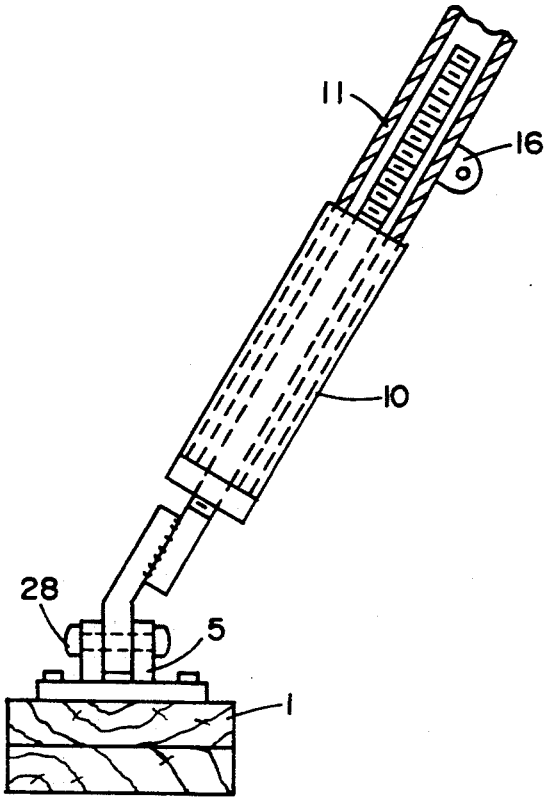
Fig. 5
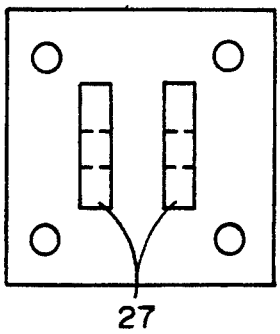
Fig. 6

Fig. 7
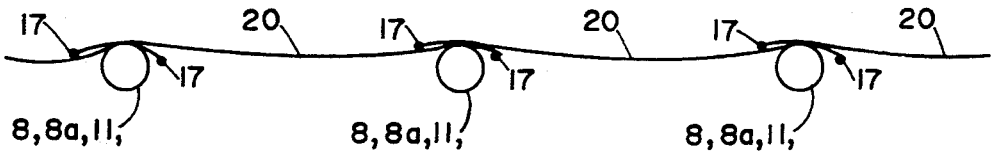
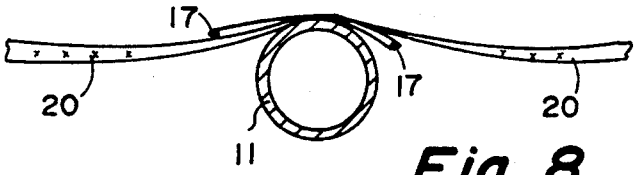
Fig. 8
Fig. 9
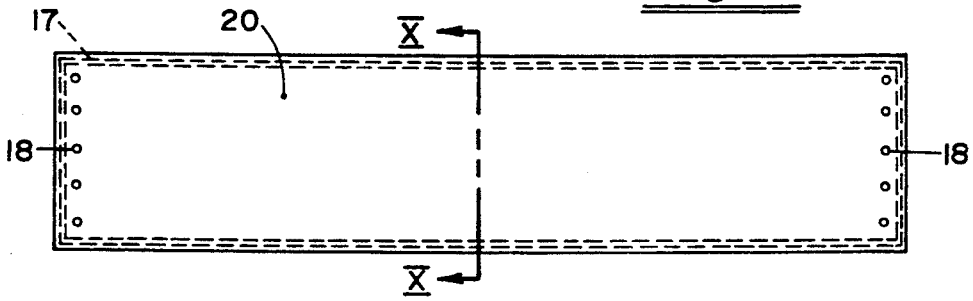
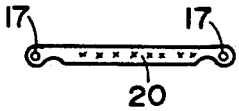
Fig. 10
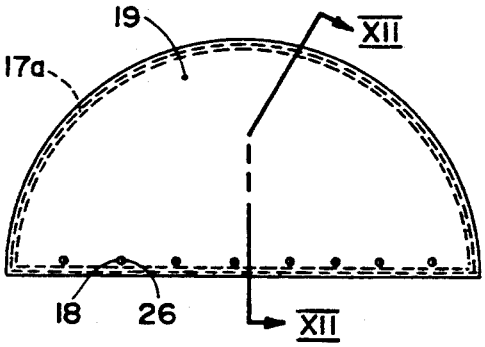
Fig. 11
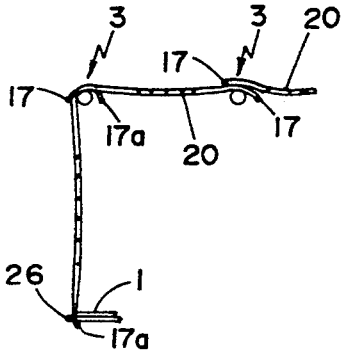
Fig. 12

COVERED FRAME SHELTER AND METHOD OF ERECTION

This application relates to shelters and more particularly to portable fabric covered frame shelters.

BACKGROUND OF INVENTION

The need for shelters at low cost that can be easily provided in a variety of locations for varying periods of time became of the utmost importance as world wide development took place at an ever increasing rate.

Many of the present shelters require heavy steel frame structures with a steel cover which requires a great deal of time and equipment such as cranes to assemble which of course could also be dangerous. With the need for something less costly and more versatile new structures and methods have been put forth as shown in U.S. Pat. No. 4,667,692 and Canadian Patent 1,246,960. In U.S. Patent "692" there is shown a multipurpose utility shelter which includes a metal frame with a durable fabric attached between frame sections. There is also provided as does applicants device single reinforcing members and/or "X" shaped reinforcing members. What applicant provides and is not even suggested is a sectioned tubular frame joined by a special coupler and covered by special flexible sheets that overlap at the ribs, and ribs that are vertically adjustable to tension and secure the cover. In Canadian Patent "960" there is presented a structure in which the frame is preassembled on the ground, then pivotally erected and the space between the frame members is filled by panels of fabric. While this is basically similar to applicants structure, applicant has made definite improvements that enhance the assembly and utility thereof. Applicant has provided a new rib structure with fast assembly coupler, a new easy method of placing the panels over the structure, a new vertical rib adjustment feature and a new method of erection.

SUMMARY OF THE INVENTION

It is desirable in storing articles or equipment to have the storage facility easily erected, movable to various locations with no lost time and at a price that is acceptable under the circumstances. To achieve these results one embodiment of the present invention comprises a generally rectangular base upon which is mounted spaced pivotal mountings. To the mountings are pivotally attached ribs of a framework over which is applied panels of a fabric. The panels are applied to the ribs in a panel edge overlapping manner. The panels are then fastened to the base by panel and base penetrating fasteners. An adjustment is incorporated in the spaced mountings to tighten the fabric and cords in the panel edges thereby securing the panels on the ribs and also the end walls if installed. A unique coupler has been used in the rib units for fast easy on site assembly thereof. Purlins and cross bracing between the ribs add to the stability of the structure. The erection of the structure is by providing a base, fastening pivotal rib supports to the base, assembling the ribs and purlins using pin fasteners fastening the ribs to the pivotal supports, pivoting the frame including ribs and purlin spacers to an upright position, stabilizing by cross bracing, applying the panel coverings over the ribs, and end walls when included, fastening the panels to the base, adjusting the spaced pivotal mountings upwardly thereby rendering the panels taut and secured in partial wrap around fashion on the ribs thereby enhancing the stability. From the above summary is readily discernible that the principle object of the present invention is to provide a shelter that is simple, rugged and easy to assemble and erect.

It is a further object of the present invention to provide a special rib coupler for ease of rib assembly.

It is a further object of the present invention to provide cover panels with draw ropes and fastener grommets to secure in an overlapping and sealing manner the panels on the frame.

It is another object of the present invention to provide a vertically adjustable pivotal rib support to thereby tighten the flexible fabric panels.

These and other objects of the present invention will become readily apparent as the following description is read in conjunction with the accompanying drawings wherein like reference numerals indicate like elements throughout the several views.

DESCRIPTION OF THE DRAWINGS

FIG. 4 is a detailed elevation view of the coupler used in assembling the ribs. A smaller included angle has been used only for illustration purposes.

FIG. 5 is an elevation view of an adjustable pivotal rib support mounted on the base.

FIG. 6 is a plan view of the mounting plate of the adjustable pivotal rib support.

FIG. 7 is a schematic cross section of the covering top panels as applied over the ribs.

FIG. 8 is a cross section of the overlapping sealing and securing panel edge joint as iris applied to a rib taken at cutting plane VIII—VIII in FIG. 1.

FIG. 9 is a plan view of a typical top cover panel as shown applied in FIG. 1.

FIG. 10 is a cross sectional view taken at plane X—X in FIG. 9.

FIG. 11 is an elevation view of an end wall panel which could be applied to FIG. 2 or FIG. 3.

FIG. 12 is a cross section of the end panel of FIG. 11 taken along the cutting plane XII—XII showing its manner of securement.

DETAILED DESCRIPTION OF INVENTION

Figure 1:
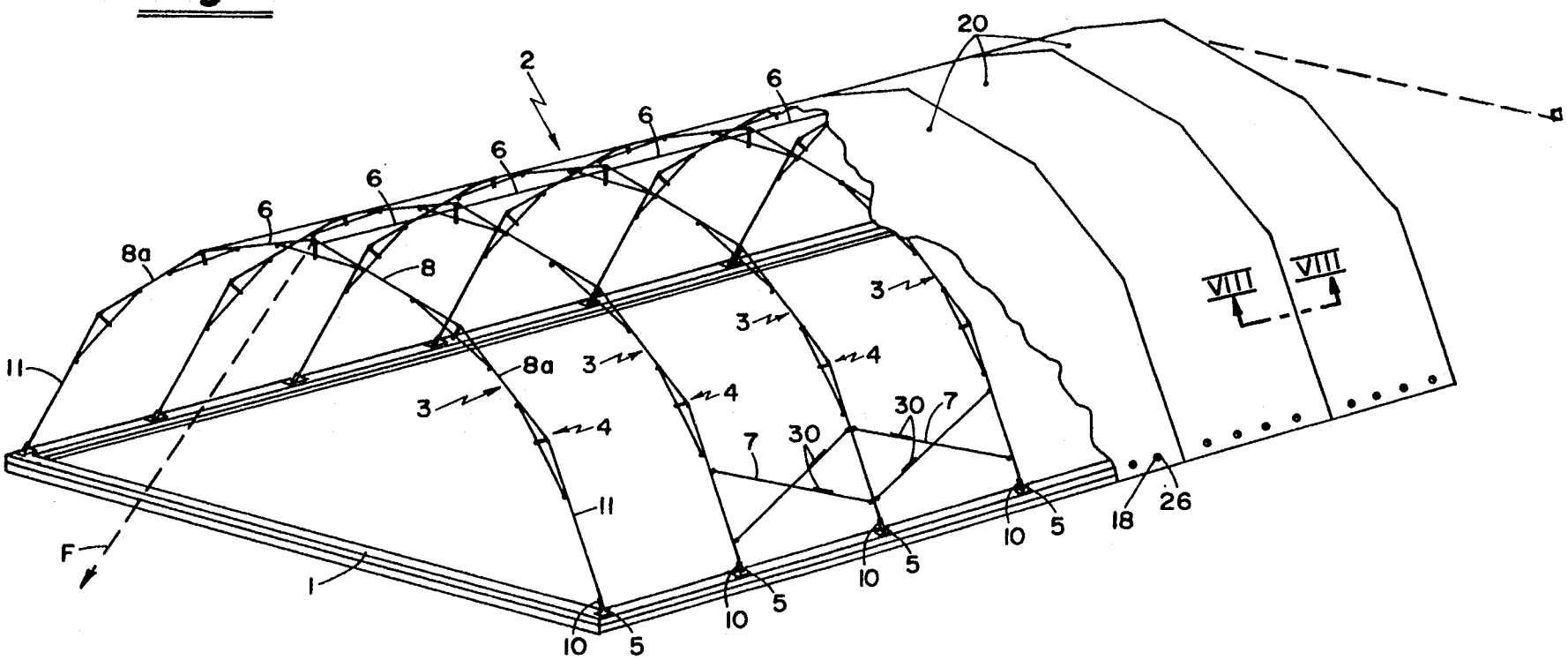
FIG. 1 is a perspective schematic view of a basic shelter with incomplete numbering for the sake of clarity.

Referring now to FIG. 1 there is shown in schematic for clarity a basic shelter without a covered front end wall and without a covered rear end wall. A base 1 is placed on the ground or any other basically planar surface. The base 1 is generally formed of two 2×8 planks of wood fastened one on top of the other forming a basically rectangular shape for example a 40 foot×60 foot shape foundation. To the base 1 are nailed or otherwise fastened in a spaced relation rib pivot supports 5 including a rib adjuster 10 more clearly shown in FIG. 5. Ribs 3 are assembled from various tubular members such as 8, 8*a*, 11, which are joined by a rigid rib coupler 4, detailed in FIG. 4, and assembly pins 9. The assembled ribs 3 are pivotally connected to pivot supports 5 and are spacedly and pivotally joined at their upper extremities by purlins 6. The purlins 6 are pivotally connected by assembly pins 9 to pin receiving tabs fixed to rib coupler 4 only the upper purlins 6 are shown but the ribs 3 may be connected by any desired number in a similar manner. To avoid snow buildup when the ribs 3 are covered the purlins 6 may be placed to give a steeper slope to the outside of the cover. The outside cover of the basic structure is generally formed of several rectangular flexible cover sheet panels of sheet material 20 which may be of a fabric which includes insulating material. Other flexible sheet materials such as plastic are also envisaged. A panel 20 in detail is shown in FIG. 9. A cutting plane VIII—VIII reveals in detail how the panels 20 overlap and is shown more clearly in FIG. 8. The securing of the cover sheet panels 20 to the ribs 3 is done by fastening the ends of the panels 20 to the base 1 by nails, screws etc. designated 26 passing through grommets 18 and into the base 1. The rib adjuster 10 is then adjusted upwardly tightening the panels 20 with the ropes 17 partly around the ribs 3. For assembly of the basic shelter, a foundation is placed on a basically horizontal surface. The ribs 3 are assembled and pivotally fastened to the pivot support 5. Purlins 6 are pivotally connected to ribs 3 by assembly pins 9 and a longitudinal force "F" is applied at one end to an upper most point of and end rib 3. Once this basic frame has been erected it may be stabilized by more purlins 6, the securing of the cover sheet panels 20 to the ribs 3 and base 1, and diagonal cross bracing 7 placed between the ribs 3. As previously pointed out only a sampling of purlins 6 and cross bracing 7 has been shown for the sake of clarity. More stabilizing may be applied depending on the expected load to be supported. This basic structure may be used as an extension to any other building.

Figure 2:
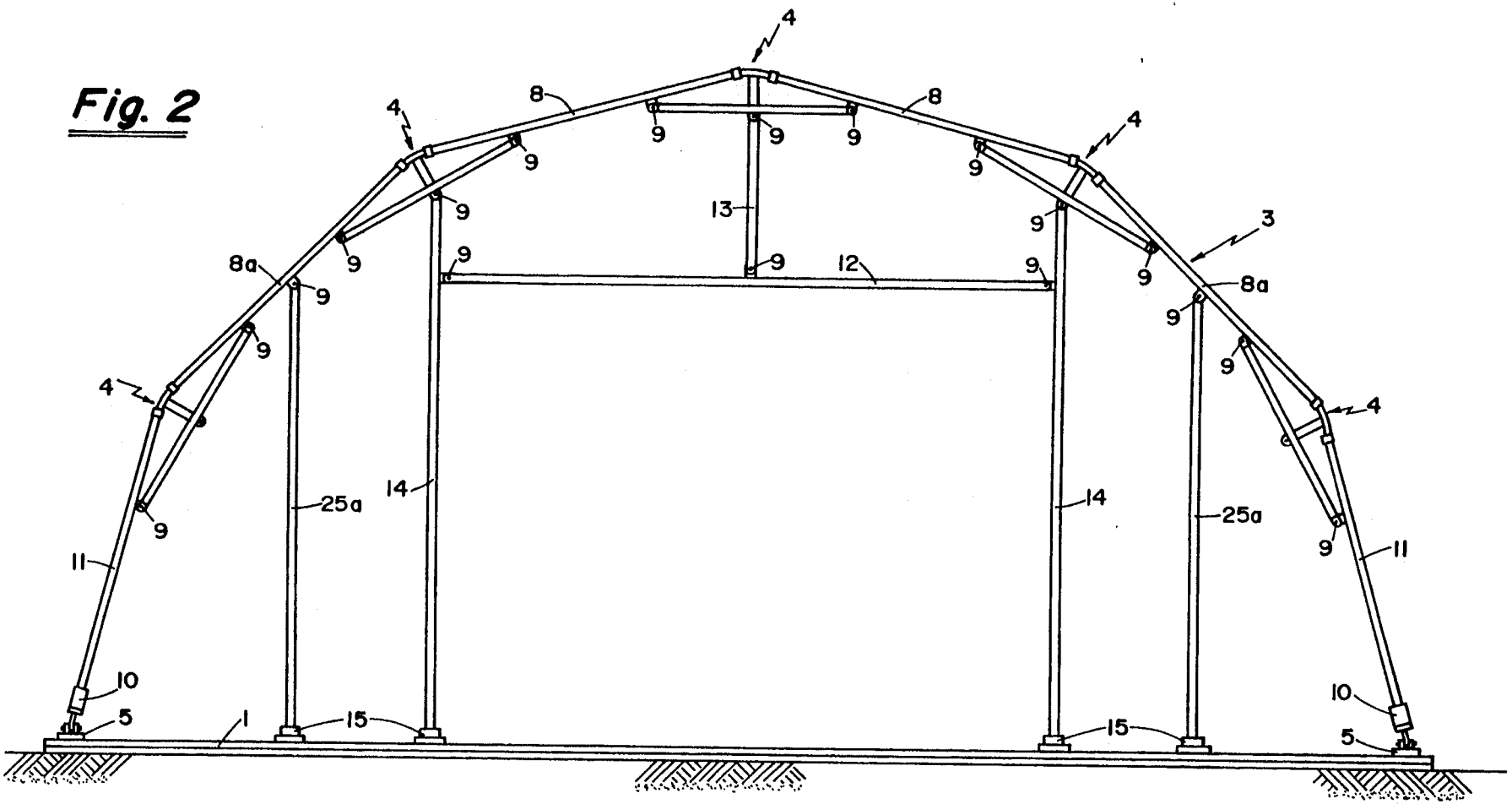
FIG. 2 is an elevation view of the front end wall frame as it would be applied to FIG. 1.

FIG. 2 is directed to an uncovered front end wall joined to an end rib 3. This end rib 3 is shown in more detail and is the same as all the remaining ribs except that some of the tubular sections from which it is formed such as **8*a* have one or more extra tabs welded thereto to receive and be pivotally connected by assembly pins 9 to end wall frame post 25*a*. The end wall posts 25*a* and door jambs 14 are supportedly mounted on the base 1 by base plates 15. Door jambs 14 are pivotally fastened to a tab at their upper ends to a rib coupler 4. The header 12 is pivotally connected by assembly pins 9 to door jambs 14 and header center 13. Header center 13 being joined by an assembly pin 9 to a rib coupler 4. The rib couplers here are all the same and are shown in detail in FIG. 4. The rib 3 shown here is formed by coupling frame support pipes 11 to frame sectional pipes 8*a* with extra tab to standard frame sectional pipes 8, which are coupled together by a further coupler 4. This assembled rib is pivotally mounted to the base 1 by pivot support 5 having a pivot support adjuster 10 which receives frame support pipe 11**. The end wall structures may be assembled and connected to the basic shelter frame before or after vertical erection of the basic shelter.

Figure 3:
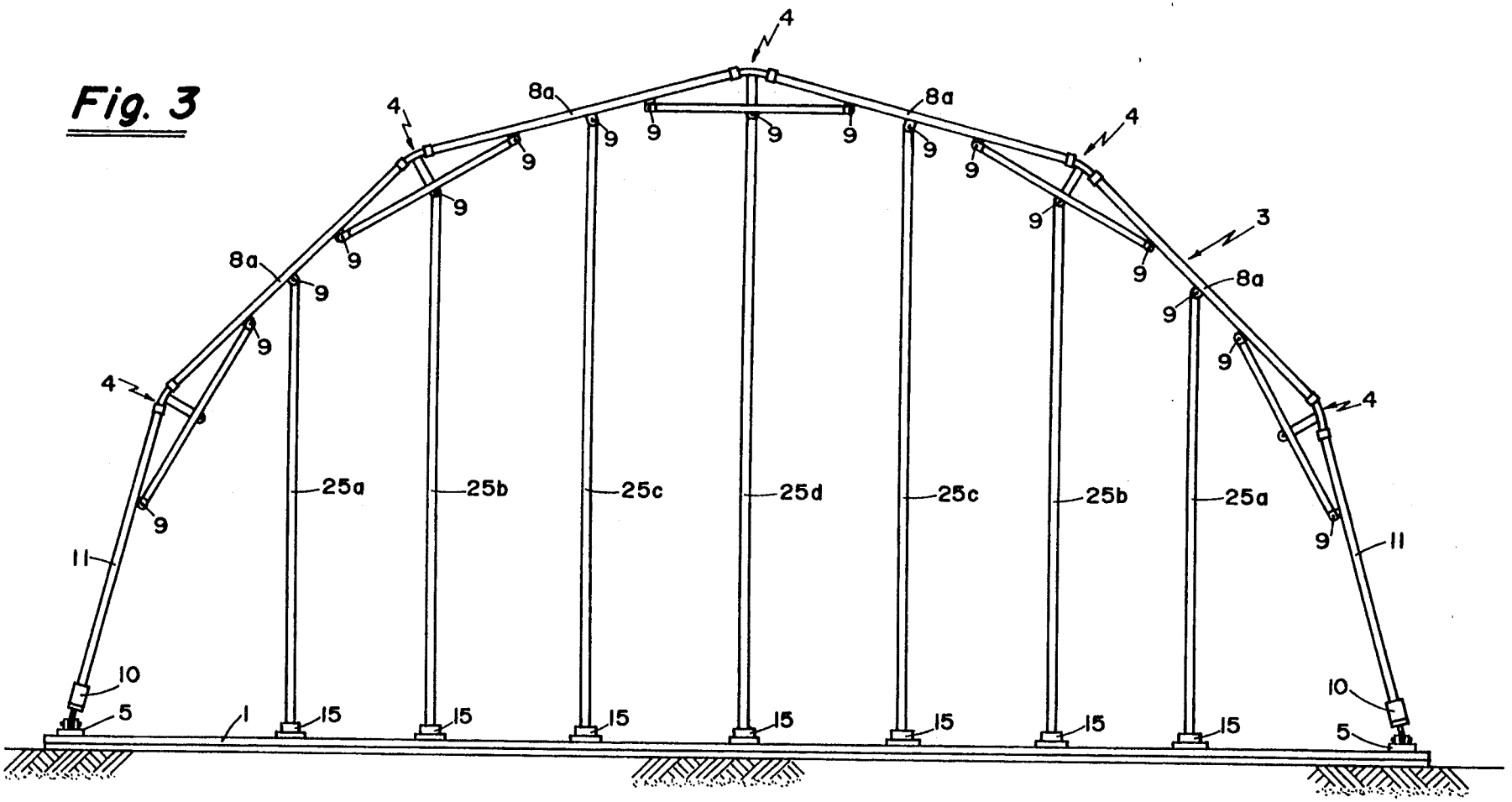
FIG. 3 is an elevation view of the rear end wall frame as it would be applied to FIG. 1.

FIG. 3 is directed to an uncovered rear end wall joined to an end rib 3. The end wall is formed of end wall frame posts **25*a*, 25*b*, 25*c* and 25*d* and the end rib 3 deviates from the standard rib only in that the frame sectional pipes 8 are replaced with frame sectional pipes 8*a* having extra tabs to receive the frame posts 25*a* and 25*c*. The remainder of the end wall frame posts are pinned to couplers 4 by assembly tabs and pins 9. All of the end wall frame posts are supported and fastened to the base 1 by base plates 15**.

Now referring to FIG. 4 there is shown two standard tubular pipes 8 with tabs which are called frame sectional pipes and are not in themselves inventive, but they can have welded thereon extra pin receiving tabs in which case they are designated **8*a*. The frame sectional pipes 8 as shown are joined by a rib coupler 4 which receives adjacent ends of frame sectional pipes 8 in coupler first end member 23. Coupler second end member 24 joins the two frame sectional pipes 8 by being pinned thereto by assembly pins 9. Coupler first end member 23 and coupler second end member 24 are joined by an elongate body member 22. The elongate body member 22 carries assembly pin receiving tabs 21 to receive assembly pins 9 which permits connection of a purlin 6 or other reinforcement or stabilizer such as crossbrace 7 to be attached thereto. For illustrative purposes only the included angle of the coupled pipes 8** is much less than in the remaining drawings.

To look at the vertical frame adjustment there is shown in FIG. 5 the rib pivot support 5 which is fastened to the base 1 by spikes, screws or any other means. Included in the rib pivot support 5 is a rib pivot support rib adjuster 10 which has a threaded rod and a threaded nut carrying a housing to receive a frame support pipe 11. On the frame support pipe 11 there is fixed a cross brace assembly pin receiving tab 16 to receive cross bracing 7 which is pin connected to other frame ribs 3 by tabs and assembly pins 9. Each cross bracing 7 is normally two crossed flexible cables tensioned by turnbuckles 30.

For a more detailed view of the base of the rib pivot support 5 there is shown a flat square portion with fastener receiving holes and two vertical pivot tabs 27 to receive a pivot bolt 28.

Referring now to FIG. 7 there is taught in schematics a portion of the panel securing means as applied to a series of flexible cover sheet panels. The flexible cover sheet panels 20 include flexible tensile members such as continuous panel flexible draw members 17 encased or otherwise supported but slideable along all edges of the cover sheet panels 20. The flexible cover sheet panels cover the frame and in particular frame sectional tubing **8, 8*a* and 11 in an overlapping arrangement which helps to stabilize the frame as well as securing or restricting movement of the flexible cover sheet panels 20**.

FIG. 8 teaches a more detailed view of the cutting plane VIII—VIII as shown in FIG. 1. In this location the cover is passing over frame support pipe 11. The flexible cover sheet panel 20 in this case is indicated to be of the insulated type but may be a sheet of plastic and along its edges are encased a flexible draw member 17 which when drawn by an upward adjustment of ribs 3 has a tendency to partially wrap the edges of sheet panels 20 around the frame support pipe 11 and all the remainder of the tubular pipes in the frame ribs 3 as applicable for securing the flexible cover sheet panels 20 and assisting in stabilizing the frame.

Now referring to FIG. 9 there is shown a flexible cover sheet panel 20. These panels generally cover the space between frame ribs 3 but are of course slightly wider in order for the partial wrap around. The flexible cover sheet panel 20 as shown is rectangular but may be of a different shape and may be made of fabric, vinyl or other suitable material that is sufficiently flexible. In all edges of the flexible cover sheet panel 20 is a continuous panel flexible draw member 17 encased or otherwise moveably supported. At the ends of the flexible cover sheet panel 20 are provided grommets 18 to receive fastening means 26 for fastening the flexible cover sheet panel 20 to the base 1.

FIG. 10 is a cross section taken at X—X in FIG. 9 to give some idea as to how the panel flexible draw members 17 may be encased in the edges of an insulated cover sheet panel 20.

In FIG. 11 we have shown a rear end view of the shelter having an end wall cover 19 with its end flexible draw member 17*a* drawn to cause it to partially wrap around the end frame rib 3. The bottom of end wall cover 19 has grommets 18 through which passes fasteners 26 to engage base 1. A front end wall cover will be the same as end wall cover 19 except that it will have a square or rectangular exit and entrance opening being covered by using the same flexible material from which the shelter is formed.

Referring now to FIG. 12 there is shown a cross section XII—XII of FIG. 11. The end wall cover 19 has been placed on the end frame rib 3 in a non adjusted position. The bottom of the end wall cover 19 is then completely secured by passing fasteners 26 through the grommets 18 at the bottom of end wall cover 19 into the base 1. The end rib 3 is then adjusted vertically by rib adjuster 10 to cause flexible draw member 17*a* to secure end wall cover 19 to end rib 3. Flexible cover sheet panels 20 can be placed over the frame ribs 3 and secured before or after placement of the end wall cover(s) 19.

It is to be understood that "X" braces may or may not be required and that they may be placed between the ribs before or after the covering is applied. It is also to be understood that the end walls may be assembled to the end frame ribs before or after the ribs have been pivoted to the vertical working position. The frame may be pivoted to the upright position with the rib spacing being provided by the pivoting tensile force member "F" so that the cover means may be applied before or after the purlins 6 are attached.

Various modifications such as size, shape and arrangement of components may be made without departing from the spirit and scope of the invention. The above disclosure shall be interpreted as illustrative only and limited only by the scope of the invention as defined in the following claims.

What I claim is:

1. A fabric covered frame shelter comprising in combination, base means formed of a fastener penetratable material, frame means including rib means supporting said fabric cover and partially formed of tubular sections, said tubular sections having tabs with apertures affixed thereto, assembly pins to be received in said tab apertures, coupler means joining said tubular sections, each one of said coupler means including a first end, adjacent ends of a pair of said tubular sections restrained in said first end only by slidable insertion therein, said coupler means including a second end rigidly and integrally joined to said first end and including a linkage linking said tubular sections joined by said first end by said assembly pins engaging said linkage and said tab apertures, fabric cover means covering said frame means including cover movement restricting means for holding said cover means on said frame means, said fabric cover means formed of flexible sheets held in a partial overlapping and sealing relationship, adjustable supporting means pivotally connecting said rib means to said base means so that said frame means may be assembled in a horizontal position and pivoted upwardly to a vertical upright working position.

2. A fabric covered frame shelter as claimed in claim 1 wherein said rib means is slidably received in said adjustable supporting means.

3. A fabric covered frame shelter as claimed in claim 1 wherein said rib means includes several ribs having a rib spacing longitudinally of said shelter.

4. A fabric covered frame shelter as claimed in claim 3 wherein said flexible sheets are each a single continuously formed sheet of material having a width greater than said rib spacing.

5. A fabric covered frame shelter as claimed in claim 1 wherein said flexible sheets are rectangular with edges that support said cover movement restricting means which includes a continuous flexible draw member slidably supported at all said edges of said flexible sheets and fastener receiving grommets at each end of said flexible sheets inwardly of said flexible draw member.

6. A fabric covered frame shelter as claimed in claim 5 wherein said rib means includes several ribs having a rib spacing longitudinally of said shelter and wherein said flexible sheets are each a single continuous sheet of material having a width greater than said rib spacing.

7. A fabric covered frame shelter as claimed in claim 6 wherein said frame means further includes front frame means and rear frame means, said front frame means including an entrance opening.

8. A fabric covered frame shelter as claimed in claim 7 further including base plates fastened to said base means to supportively receive said front frame means and said rear frame means.

9. A fabric covered frame shelter as claimed in claim 6 wherein said frame means further includes purlins pivotally connected to and separating several of said rib means to enable easy pivoting of said frame means assembled from a horizontal position to an upright useable position.

10. A fabric covered frame shelter as claimed in claim 9 wherein said cover means of flexible sheet material is made of an insulated fabric and wherein said frame means further includes adjustable flexible tensile cross bracing between several of said ribs of said rib means.

11. A fabric covered frame shelter comprising in combination, base means having at least two sides, frame means including several spaced rib means for supporting said fabric cover, a portion of which is formed of tubular sections, rigid coupler means joining said tubular sections to form said rib means, said rigid coupler means having an arcuate first end member, adjacent ends of at least two of said tubular sections, slidably and releasably received in said arcuate first end member, a body member integrally joined to said arcuate first end member and an elongate second end member integrally joined to said body member and releasably pinned to said at least two tubular sections, said fabric cover being formed of at least several overlapping rectangular flexible sheets, said rectangular flexible sheets are each a single continuously formed sheet having a width greater than said space between the rib means and a length stretching between said at least two sides of said base means, fastening means penetrating said base means and said fabric cover thereby fixing said cover means to said base means and supporting means pivotally connecting said spaced rib means to said base means so that said frame means may be assembled in a horizontal position and pivoted upwardly to a vertical upright working position.

12. A fabric covered frame shelter as claimed in claim 11 wherein said supporting means is adjustable.

13. A fabric covered frame shelter as claimed in claim 12 wherein said adjustable supporting means is fastened to said base means and said spaced rib means is slidably received in said adjustable supporting means.

14. A fabric covered frame shelter as claimed in claim 13 further including a single continuous flexible draw member slidably supported and totally encased in each said rectangular flexible sheet and fastener receiving means included at each end of each said rectangular flexible sheet inwardly of said flexible draw member.

15. A fabric covered frame shelter as claimed in claim 14 wherein said frame means further includes purlins pivotally connected to and separating several ribs of said rib means and cross bracing connected between several of said several ribs and being formed of adjustable length flexible tensile members.

16. A fabric covered frame shelter as claimed in claim 12 wherein said supporting means is threadedly adjustable and wherein said frame means further includes front wall means and rear wall means with each one of said wall means formed using upright posts and each one of said wall means is fastened to a separate rib of said rib means.

17. A fabric covered frame shelter as claimed in claim 16 further including base plates fastened to said base means and supporting said upright posts.

18. A fabric covered frame shelter as claimed in claim 1 wherein said fabric cover includes substantially semicircular end walls of flexible sheet material including cover movement restricting means in the form of a continuous flexible end wall member slidable relative to said flexible sheet material and fastener receiving means to receive said penetrating fastening means.

* * * * *